United States Patent [19]

Bastide

[11] 4,080,817

[45] Mar. 28, 1978

[54] PROCESS AND A DEVICE FOR THE EXTRUSION OF MATERIALS IN THE FORM OF NARROW WIRES

[76] Inventor: Maurice Bastide, 5 Bis, rue due Cantal F., Argenteuil, France, 95100

[21] Appl. No.: 670,845

[22] Filed: Mar. 26, 1976

[51] Int. Cl.[2] ..... B21C 3/00; B21C 23/00; B21C 33/00

[52] U.S. Cl. ..... 72/253 R; 72/262; 72/263; 72/257; 72/270; 72/467; 72/377; 72/261

[58] Field of Search ..... 72/253, 270, 467, 262, 72/277, 267, 284, 285, 274, 362, 367, 377, 257, 263, 261; 29/2.2–2.25, 4.51; 82/1 C

[56] References Cited

U.S. PATENT DOCUMENTS

| | | | |
|---|---|---|---|
| 125,666 | 4/1872 | Deming | 82/1 C |
| 622,690 | 4/1899 | Howell | 29/4.51 X |
| 1,509,617 | 9/1924 | Soderstrom | 29/2.25 |
| 1,864,889 | 6/1932 | Brown et al. | 82/1 C |
| 2,370,265 | 2/1945 | Shoemaker | 29/2.23 X |
| 2,974,790 | 3/1961 | Murphy et al. | 72/253 |
| 3,765,216 | 10/1963 | Green | 72/262 |
| 3,911,705 | 10/1975 | Voorhes | 72/270 |
| 3,934,446 | 1/1976 | Avitzur | 72/262 |

FOREIGN PATENT DOCUMENTS

| | | | |
|---|---|---|---|
| 2,287,949 | 5/1976 | France | 72/253 |
| 130,651 | 1/1951 | Sweden | 72/338 |
| 676,083 | 7/1952 | United Kingdom | 72/467 |

*Primary Examiner*—C.W. Lanham
*Assistant Examiner*—D. M. Gurley
*Attorney, Agent, or Firm*—Browdy and Neimark

[57] ABSTRACT

Fine wire of indefinite length is produced at a high rate and in an economical manner from the surface of a billet, sheet or the like by creating a swelling on the surface of the work and forcing the swelling through a die in a single step.

12 Claims, 6 Drawing Figures

PROCESS AND A DEVICE FOR THE EXTRUSION OF MATERIALS IN THE FORM OF NARROW WIRES

FIELD OF THE INVENTION

The present invention relates to the extrusion of materials in the form of continuous wires by the forced passage of the extrusion material through the orifice of a die. More specifically, it relates to a novel extrusion process wherein the extrusion material is continuously removed from the surface of the material. It also relates to a device for implementing the invention and to the applications of this process, more particularly, for the manufacture of very narrow metal wires.

BACKGROUND

Various techniques have long been used for the extrusion of different types of materials. For example, in the manufacture of fine metal wires having diameters ranging between a few thousandths and a few tenths of a millimeter from wires having diameters of one or more millimeters, the raw material is passed through a set of dies of successively decreasing diameters until the desired wire diameter is obtained. In the case of copper drawing, for example, a machine designed to produce a wire having a diameter of 0.02 mm from a starting wire having a diameter of 0.1 mm, comprises at least twenty dies. Apart from the high cost of producing machines of this type, it must be appreciated that the preliminary manual operations for successively inserting the specially tapered end of the wire into each die in the series until sufficient lengths for winding on the winches are obtained, are extremely long and tedious. In addition, the diameters of the successive dies must be very exact: for example, the permissible tolerance in the case of a wire having a diameter of 0.01 – 0.02 mm is 0.001 mm. Furthermore, friction affecting the metal inside each die frequently causes breaks in the wire upstream of the die which result in loss of time and material.

OBJECT AND SUMMARY OF THE INVENTION

The present invention was designed to obviate the above disadvantages by replacing the wire drawing process which is currently used by a novel extrusion process which is extremely simple to implement and which, by virtue of the very simple apparatus employed, makes it possible to reduce the cost of conventional wire drawing machines by a factor of a number of units.

Various processes for extruding fine wires have obviously been previously proposed, particularly those employing so-called hydrostatic drawing techniques, but none of these processes make it possible to produce an extremely fine wire of indefinite length (having a diameter between one and a few tenths or hundredths of a millimeter), at a high rate (on the order of several tens of meters per second) which is generally essential for the manufacturing process to be economically viable.

The invention provides a solution to this technical problem in that it proposes a process and a device for directly obtaining a fine wire of indefinite length by means of a single drawing tool by removing the extrusion material solely from the surface of the starting material or billet which may have infinitely variable dimensions.

The novel process according to the invention is characterized essentially in that the material to be extruded is advanced in front of the die in order to maintain a localized mechanical pressure upstream of, and in the vicinity of the die orifice, and in that this material is removed in a regular manner exclusively from the surface layer of a material of infinitely variable shape and dimensions; the die directly supplying, in a single step, a continuous wire of the desired gauge and of indefinite length.

According to a main feature, the effect of the localized pressure maintained in the material by its advancement movement in front of the die, the removal of the material exclusively from the surface layer of a starting material of infinitely variable shape and dimensions and the extrusion of an endless wire through the die orifice, are simultaneously and directly achieved by means of a single unitary tool comprising the die orifice.

In the process, the material which is fed to the machine and which is advanced or rotated at high speed in front of and towards the drawing tool, may take various forms. For example, it may consist of a solid cylindrical element or a cylindrical element comprising a surface layer consisting of an extrusion material. In the latter case, the cylinder is rotated and the die is displaced on the surface of the cylinder, the material then being removed along a helicoidal path on the surface. The billet can also possess an elongated form, for example, a wire, rod, bar, strip, etc., or it can possess a flat shape, for example, a plate, sheet, etc. In the latter case, the material is removed either along one or more generatrices or along any particular path, the die remaining stationary.

According to a variant of the above process, the billet remains stationary and the die is displaced about or along the billet.

A device according to the invention, which is designed to carry out the above operations, comprises the following elements in addition to the conventional means for rotating or advancing the material to be extruded:

a) a unitary drawing tool which is generally formed from a diamond and is applied to the surface of the material. The drawing tool comprises the following elements which are listed as they occur from upstream to downstream in the direction of movement of the material:

a smooth front face designed to slide on the material and comprising an engagement incline for engagement with the material, at least one calibrated orifice having a corresponding transversal section to that of the wire to be produced and the axis of which is substantially orthogonal to the front face and, directly downstream of the calibrated orifice, at least one projecting nose or lip designed to penetrate the material to be extruded and to push it back in front of the same and force it to flow into the orifice.

b) conventional means for winding the narrow wire product onto spools after it passes through a mechanical tension accumulator-regulator.

During the extrusion operation, the front face of the tool, which comprises an incline for engagement with the billet, is firmly applied by mechanical pressure to the surface of the billet and the latter, which is being advanced as described above, slides on the front face in one direction such that the surface of the billet encounters the lip or nose directly downstream of the calibrated orifice. The application pressure is maintained at a sufficient level to enable the lip to completely penetrate the billet. During the relative sliding movement between the tool and the billet, the lip pushes back or displaces the material in front of it. This displaced material tends to produce a swelling on the surface in the proximity of the lip, more particularly, upstream of the latter, but the pressure exerted in this zone by the front face of the tool is opposed to this swelling. Thus the material is subjected to very high pressure in the zone situated in the vicinity of the calibrated die orifice and, when this pressure reaches a sufficient level, the material flows through the orifice in the form of a continuous wire.

The tool is generally made of a very hard, resistant material such as a diamond, particularly when metal wires are being extruded. This also applies to the conventional dies of drawing machines. The lip on the tool which is used to remove the material by penetrating the surface of the billet at high speed constitutes an integral part of the die and may comprise any suitable configuration which will enable it to slice the surface of a hard billet, for example, a metal, over a long period of time without excessive wear.

The die may comprise a single extrusion orifice and, downstream of and in the vicinity of the latter, a single projecting lip on the front face pressing on the billet. However, according to a variant, the tool may be designed with a plurality of calibrated orifices, either disposed immediately upstream of a projecting lip, or distributed between a plurality of lips, so as to simultaneously produce a plurality of wires having the same diameter or different diameters.

Owing to the fact that in the process according to the invention, the material, for example, the metal, is extruded solely from the surface of the billet, the latter cannot be completely converted into wire a priori. To obviate this disadvantage, which, in certain cases, could render the operation less economically viable, it is possible to increase the proportion of convertible billet, either by using a plurality of drawing tools on a single billet or by subjecting a single billet to a plurality of successive extrusion operations, or by combining the two above methods.

As indicated above, the shape and dimensions of the material constituting the billet are infinitely variable as is also the section of the wire which is produced, depending on the form preselected for the die orifice. Accordingly, in the extrusion of copper, for example, it is possible to directly obtain, in a single step, a copper wire having a diameter of 0.02 mm by using as billet, either a wire having a circular section of approximately 0.15 mm in diameter, or a strip or wire having a circular section flattened by crushing, or a cylindrical rod of any given diameter, or a sheet or plate or any other form of starting material.

A particularly advantageous feature of the process according to the invention consists in that as the wire is extruded from the surface of the billet, it is possible to precoat any type of support consisting of a hard material, such as ceramic, metal carbide, etc., with a layer of extrusion material produced by electrolysis, by sublimation under vacuum, or by any other type of process; the wire then being extruded solely from the thickness of this coating. This method makes it possible to economically produce an extremely pure wire possessing excellent metallurgical properties and comprising a minimum of faults capable of producing breaks. Thus, according to a particular application of the invention, it is possible to continuously produce metal wires, for example, copper wires, from a billet consisting of a plurality of cylinders made of a hard material and mounted for rotation on a rotary element for the purpose of successively subjecting them to the following operations: coppering, rinsing, drying, extrusion of the wire, scouring, rinsing, drying, decoppering and recoppering, etc., in a continuous cycle. It is obviously possible to apply the metal coating to the surface of the hard support by other methods than electrolysis, for example, by means of chemical deposition processes, by metallization under vacuum or by any other conventional method.

According to another mode of implementing the process according to the invention, when the billet consists of a wire, for example a metal wire having a relatively large diameter, it is particularly advantageous to cause this wire, which is being driven at high speed on a wind-on wind-off unit, to be continuously advanced in front of the drawing tool by passing it over a rotary cylinder made of hard material and disposed opposite the drawing tool. According to an improvement of this mode, this cylinder advantageously comprises on its surface, a circular groove or channel acting as a guide for the wire. At the output of the die or dies, the wire is rewound under sufficient tension to ensure that the combined effect of this tension and the contact with the rotating cylinder causes the wire to be advanced at a regular rate.

BRIEF DESCRIPTION OF DRAWINGS

Other objects, features and advantages of the present invention will be made apparent in the following detailed description of a drawing tool having the above-described features (FIGS. 1A-1D) and of various modes of implementing the same which are represented briefly in FIGS. 2 and 3 and which will be described hereinafter. More particularly.

DETAILED DESCRIPTION OF EMBODIMENTS

Figure 1B:
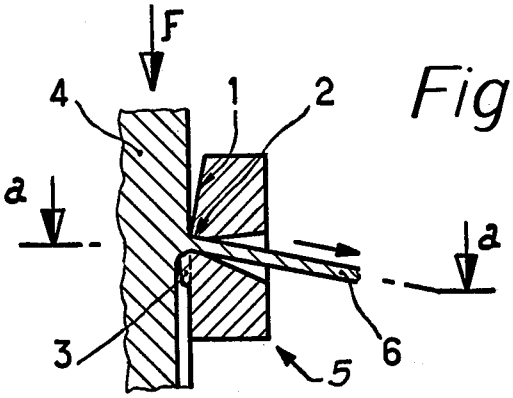
FIGS. 1A and 1B represent, in sections *a—a* and *b—b*, sections disposed at 90° from one another, an implement in accordance with the present invention.
Figure 1A:
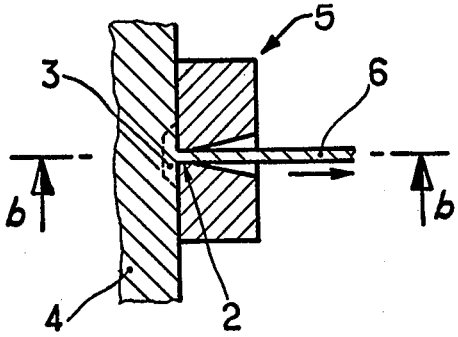

Referring now to FIGS. 1A and 1B, the drawing tool 5 comprises essentially: a smooth front face 1 comprising a gentle incline for engagement with the supply billet, a calibrated orifice 2, the axis of which is substantially orthogonal with respect to the front face and a lip or nose 3 which projects from the front face and which is situated in the immediate vicinity of the orifice 2. To carry out the extrusion process, the billet 4 is rotated or advanced in front of the tool by the firm application of the front face 1 on the surface of billet 4. During its displacement according to the arrow F, the surface of the billet 4, for example, a metal billet, encounters the lip 3 directly downstream of the orifice 2. The application pressure of front face 1 on the surface of billet 4 must be sufficient for the lip 3 to penetrate fully into the billet 4. During the relative sliding movement between the tool and the billet, the lip pushes back the metal in front of the same. This metal, which forms a surface deformation, against which the application pressure of the front face 1 is exerted, is exposed to very high pressure in the zone at the input of the calibrated orifice 2. When this pressure reaches a sufficent level, the metal flows through oriface 2 in the form of a continuous wire 6.

Figure 1D:
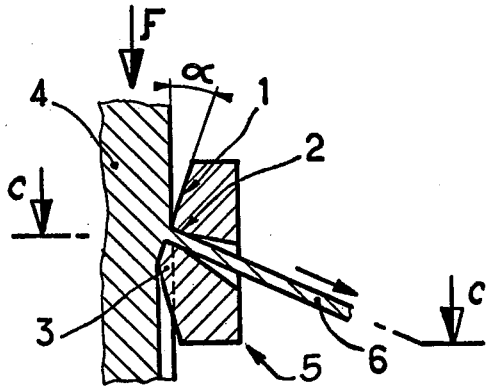
FIGS. 1C and 1D represent, in sections *c—c* and *d—d*, sections disposed at 90° from one another, another embodiment of an implement in accordance with the present invention.
Figure 1C:
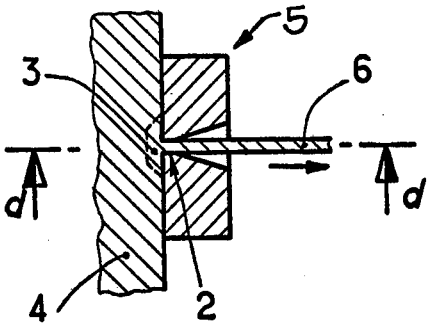

According to a variant represented in FIGS. 1C and 1D, the upstream face of the lip 3 of the tool 5 may be worked simultaneously with the front face 1 and in extension of the latter. In this case, the engagement incline must be sufficiently large to provide the lip 3 with adequate penetration depth. This engagement incline is designated in FIG. 1D by the angle alpha. However, this is a simplified representation as the front face 1 is not necessarily flat.

According to the above-mentioned variant, it is the drawing tool which is capable of being displaced about or along the billet which remains stationary.

In order to cool and improve the operating conditions of the drawing tool, it may obviously be necessary to carry out a lubrication operation using any conventional means.

OPERATING EXAMPLES

By using $Lp$ to designate the length of the path travelled by the drawing plate on the surface of the billet, and $Lf$ to designate the corresponding length of the wire produced, the linear production output can be defined as $R = Lf/Lp$. This output is a function of a number of parameters such as the shape and dimensions of the drawing tool, the application pressure of this tool, the nature and section of the extruded wire, the sliding rate relative to the front face 1 on the surface of the billet (FIG. 1) lubrication, etc.

In practice, when the process according to the invention is implemented, R is often comprised between 0.5 and 2 but it can also attain much higher values. In the following examples, which relate to the production of a copper wire having a circular section of 0.02 mm in diameter and in which a diamond drawing tool is used, R will be equal to 1.

Example 1

Figure 2:
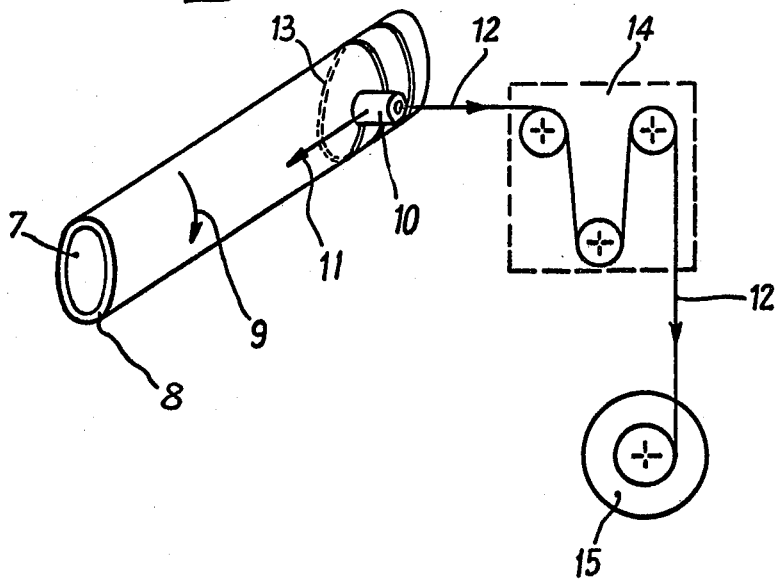
FIG. 2 is a schematic view of an extrusion apparatus utilizing an implement according to the present invention.

This example illustrates a method of extruding copper wire from an electrolytic copper surface layer deposited on a cylindrical steel support and it refers to the simplified diagram in FIG. 2.

The support is a ground steel cylinder 7 having a circumference of 1m and length of 1.5m. It is coated with a layer of electrolytic copper 8, 0.03 - 0.06 mm in thickness, and then mounted on a special machine (not represented) operating in the manner of a lathe, the cylinder rotating in the direction of the arrow 9.

The drawing tool 10 (the structure of which is identical to those represented in FIG. 1) moves along the cylinder in the direction of the arrow 11. It removes a copper wire 12 from the thickness of the deposit 8 by following a helicoidal path 13 on the cylinder. The wire 12, which is produced, passes over a conventional mechanical tension accumulator - regulator 14 before being wound on the receiving spool 15.

The drawing tool advances by 0.15 mm per rotation and the total path covered by this tool is 10,000 m. When R = 1, the length of the wire produced is also 10,000 m, which corresponds to about 30 g. copper wire having a diameter of 0.02 mm. The duration of the operation was about 10 minutes.

After the copper supply constituted by the electrolytic deposit 8 has been used up, the cylinder is removed from the machine. It is then scoured, rinsed, dried, electrolytically decoppered, recoppered, rinsed, dried, and then replaced on the machine. The periods of inoperation can obviously be kept to a minimum by mounting a plurality of cylinders on one rotary element.

A machine of the type described above can produce a minimum of 150 g, that is, 50 km/hour of a high quality copper wire, using a single drawing tool. A single operator without any special skill can easily control at least two machines of this type operating in parallel.

Example 2

Figure 3:
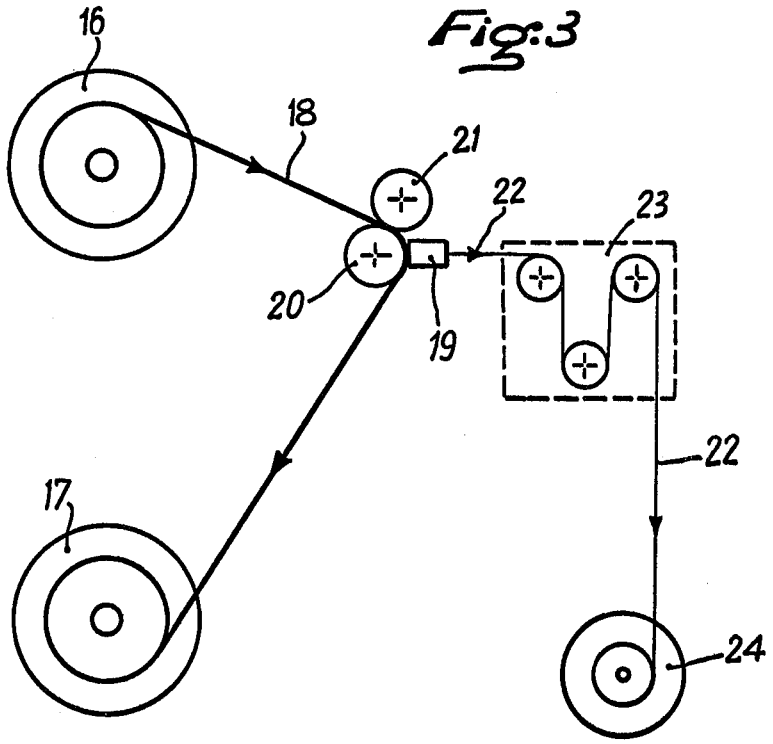
FIG. 3 is a schematic view of another embodiment of an extrusion apparatus utilizing an implement according to the present invention.

This example illustrates a method of removing copper wire from the surface, according to a generatrix, of a cold-hammered copper wire billet having a diameter of 0.50 mm. It is provided in reference to the simplified diagram shown in FIG. 3.

A unit comprising a wind-off element 16 and a wind-on element 17 and operating with controlled wire tension enables the billet 18 to be advanced in front of the drawing tool 19 at a rate of approximately 1,000 m per minute. Opposite the tool 19, the billet wire passes over a rotating cylinder 20 which is made of a hard material and which preferably comprises a small circular groove designed to guide the wire 18. The combined effect of the wire passing over the cylinder 20 and the rewinding tension at 17 ensures that the billet is advanced at a regular rate in front of the tool 19.

According to an improvement, the billet 18 can be flattened on the cylinder 20 by means of a press roller 21 before the wire passes in front of the tool 19. This mode of operation substantially increases the linear output R.

As in example 1, the fine wire 22 which is produced with a diameter of 0.02 mm, passes through a mechanical tension accumulator-regulator 23 before being wound on the receiving spool 24.

Under these operating conditions, when R = 1, the production rate is 10 km wire (or 30g) in 10 minutes. This corresponds to a rate of 60 km/hour (or 180g wire). A single operator without any special skill can control a plurality of similar machines operated simultaneously.

The invention is obviously not limited to the embodiments and applications described above and may be used to produce various types of wires, metal or otherwise, according to different variants, comprising the main features which are described above and in the claims. The invention makes it possible to produce narrow wires from materials which are reputedly very difficult, if not impossible to draw, for example, magnesium, titanium, etc. In view of the fact that a very fine wire is directly produced in a single step and in view of the considerable reduction in material and work, the new process according to the invention is characterized by extremely advantageous cost factors as compared to the drawing processes currently employed.

What is claimed is:

1. In a process for extruding a material in the form of very fine gauge wire by the forced passage of the extrusion material through the orifice of a die, the improvement comprising providing a tool having said die therein, a smooth face upstream from said die, and a projection means immediately downstream from said die to penetrate the material to be extruded and to push it back into the die, advancing a body of extrusion material in front of the die to create and maintain a localized mechanical pressure from said projection means on the surface of the body of material immediately upstream of and in the vicinity of the die orifice, and thereby causing by said localized pressure the high-pressure displacement of the extrusion material lying on the surface of the body immediately upstream of the die orifice, regularly and exclusively removing said displaced material from the surface layer of the body of extrusion material and forcing said displaced material through said die, thereby directly supplying, in a single step, a continuous wire of the desired gauge and of indefinite length, and collecting the wire.

2. A process as claimed in claim 1, wherein the effect of the localized pressure maintained in the material by its advancement movement in front of the die, the removal of this material exclusively from the surface layer of the material body and the extrusion of a wire of indefinite length through the orifice of the die, are simultaneously and directly obtained by means of a single unitary tool comprising the die orifice.

3. A process as claimed in claim 1 wherein the material is removed from the extrusion material body on the surface of a rotating cylinder by moving the die according to a helicoidal path.

4. A process as claimed in claim 1 wherein the removal of the material is effected along one or more generatrices on the surface of an elongated extrusion material body, which is continuously advanced, said body comprising a wire, strip or bar.

5. A process as claimed in claim 1 wherein the removal of the material is effected along a path on the surface of a flat extrusion material body which is continuously displaced relative to said die, said body comprising a sheet or plate.

6. A process as claimed in claim 1 wherein the material body is stationary and the drawing tool is moved over the surface of the material body.

7. A process as claimed in claim 1, wherein the extruded material is removed from the surface layer of a massive body.

8. A process as claimed in claim 1, wherein the extrusion material body is in the form of a surface coating and the material is only removed from this coating.

9. A process according to claim 1 for the manufacture of narrow copper wire from rotating cylinders made of a hard material and comprising a copper surface layer as the material body, comprising subjecting the cylinder to the operations of scouring, rinsing-drying and decoppering in a continuous cycle, after removal of the coating by the die and then recoppering the cylinder prior to a further extrusion step.

10. A device for extruding a material in the form of a very fine gauge wire by the forced passage of extrusion material through a die, comprising a unitary drawing tool die formed from a diamond, and which is applied to the surface of a body of extrusion material, said tool comprising, from upstream to downstream in the direction of movement of the material body: a smooth front face designed to slide on the material body and having an engagement incline for engagement with said material body, at least one calibrated orifice having a corresponding transverse section to that of the wire to be produced, the axis of which is substantially orthogonal to the front face and, directly downstream of the calibrated orifice, means comprising a projecting lip or nose to penetrate the extrusion material and push it back in front of the lip or nose, forcing it to pass through said orifice;

means for moving the extrusion material body relative to the die; and means for receiving the narrow wire product on spools.

11. A device according to claim 10 for the continuous manufacture of narrow metal wire by extrusion from a material body in the form of a heavy gauge wire having a large diameter, comprising means to drive said heavy wire at high speed on a wind-on wind-off unit and continuously advance same in front of the drawing tool; and a rotary cylinder consisting of a hard material, disposed opposite the drawing tool and comprising a circular groove for guiding the heavy gauge wire;

and means for receiving said heavy gauge wire, from which said narrow metal wire has been formed, downstream from the drawing tool.

12. A method in accordance with claim 1 wherein said extrusion material is metal.

* * * * *